US007453336B2

(12) United States Patent
Tschernitz

(10) Patent No.: US 7,453,336 B2
(45) Date of Patent: Nov. 18, 2008

(54) COUPLING STRUCTURE FOR CYLINDRICAL RESONATORS

(75) Inventor: Maximilian Tschernitz, Freising (DE)

(73) Assignee: Siemens Aktiengesellschaft, Munich (DE)

( * ) Notice: Subject to any disclaimer, the term of this patent is extended or adjusted under 35 U.S.C. 154(b) by 212 days.

(21) Appl. No.: 10/576,619

(22) PCT Filed: Oct. 8, 2004

(86) PCT No.: PCT/EP2004/052481

§ 371 (c)(1),
(2), (4) Date: Apr. 21, 2006

(87) PCT Pub. No.: WO2005/041346

PCT Pub. Date: May 6, 2005

(65) Prior Publication Data

US 2007/0075807 A1 Apr. 5, 2007

(30) Foreign Application Priority Data

Oct. 21, 2003 (DE) ..... 103 48 909
Oct. 4, 2004 (DE) ..... 10 2004 048 274

(51) Int. Cl.
*H01P 1/20* (2006.01)
*H01P 7/10* (2006.01)

(52) U.S. Cl. ..... 333/202; 333/219.1; 333/227

(58) Field of Classification Search ..... 333/202, 333/219, 219.1, 227
See application file for complete search history.

(56) References Cited

U.S. PATENT DOCUMENTS 4,307,352 A * 12/1981 Shinkawa et al. ..... 331/99
4,835,498 A * 5/1989 Rouger et al. ..... 329/354
5,457,431 A 10/1995 Fuentes et al.
6,127,907 A * 10/2000 Furuya et al. ..... 333/235

(Continued)

FOREIGN PATENT DOCUMENTS

DE 199 15 074 A1 9/2000

(Continued)

OTHER PUBLICATIONS

Virdee: "Effective technique for electronically tuning a dielectric resonator", Electronic Letters, vol. 33, No. 4, Feb. 13, 1997, pp. 301-302.

*Primary Examiner*—Robert J. Pascal
*Assistant Examiner*—Kimberly E Glenn
(74) *Attorney, Agent, or Firm*—Laurence A. Greenberg; Werner H. Stemer; Ralph E. Locher

(57) ABSTRACT

A filter module suitable for the filtering of electromagnetic waves includes a dielectric cylindrical resonator and one or more lines that supply or draw off electromagnetic waves to or from the dielectric resonator. The lines terminate in a contacting structure. The resonator has a variable separation from the lines, whereby the separations may be conceived in both the negative as well as alternatively in the positive longitudinal direction (z-axis) of the resonator. The transmitted signal power may be significantly increased in an advantageous manner relative to conventional coupling structures by means of the above. The above is particularly suitable for application in oscillator circuits with operating frequencies above 18 GHz, such as typically find increasing application in environment systems of a motor vehicle such as Lane Departure Warning (LDW), Blind Spot Detection (BSD) or Rear View Detection.

36 Claims, 2 Drawing Sheets

U.S. PATENT DOCUMENTS

| | | | | |
|---|---|---|---|---|
| 6,175,286 | B1 | 1/2001 | Ueno | |
| 6,249,196 | B1 * | 6/2001 | Ishigaki et al. | 333/219 |
| 6,480,078 | B2 * | 11/2002 | Kim et al. | 333/219.1 |
| 7,310,031 | B2 * | 12/2007 | Pance et al. | 333/219 |

FOREIGN PATENT DOCUMENTS

| | | | |
|---|---|---|---|
| EP | 0 197 653 | A2 | 10/1986 |
| EP | 0 961 340 | A1 | 12/1999 |
| JP | 11 027034 | | 1/1999 |
| JP | 2001060810 | A | 3/2001 |

* cited by examiner

COUPLING STRUCTURE FOR CYLINDRICAL RESONATORS

BACKGROUND OF THE INVENTION

Field of the Invention

The present invention relates to a filter element suitable for filtering electromagnetic waves, in particular a bandpass filter or band-stop filter, implemented also as a reflection filter or suchlike, containing a dielectric, cylindrical resonator and one or more lines which supply or, as the case may be draw off electromagnetic waves to/from the dielectric resonator, with said lines terminating in a suitable contacting structure. The present invention relates also to an oscillator constructed using a filter element of said type.

Commercially available resonators, which is to say oscillating systems whose individual elements are tuned to a required (natural) frequency so that the resonator will oscillate at that frequency when excited, have many uses in both low-frequency and high-frequency technology. Depending on their physical design, material, and shape they are suitable, for example, as a very simple (narrowband) filter, as a frequency-determining element of an oscillator, for measuring material characteristics in the HF field, or as a short-term electro-magnetic-energy storage (employed in particle accelerators).

Microstrip-line resonators, cavity resonators, or what are termed dielectric resonators embodied, that is to say, for the most part from a ceramic material are employed in the area of high-frequency technology depending on the specific application. The last-mentioned resonators are frequently used having a cylindrical shape as electrical or, as the case may be, electromagnetic filters and hence also as filters for generating oscillations in resonator circuits. The therein achievable characteristics of filters of said type and hence also of the oscillators produced using them (for example their power levels and noise characteristics) are, however, crucially dependent on the coupling of the dielectric resonator to the supply lines or, as the case may be, draw lines.

Cylindrical dielectric resonators are presently mounted on a printed-circuit board predominantly with one of their flatly embodied end faces spaced at a certain distance from the top side thereof. Located on said top side of the printed-circuit board are one or more lines which supply or, as the case may be, draw off electromagnetic waves to/from the dielectric resonator. A typical structural design often used in products such as, for instance, local oscillators and filters for radar systems, satellite receivers, and wireless distribution services for digital television such as local multipoint distribution services (LMDS) and suchlike is outlined in FIG. 8.

The structural design shown in FIG. 8 can lead to serious problems in the production of oscillators in the presence of increasing operating frequencies in particular in what is termed the K band, which-is to say in the microwave range of 18-26.5 GHz. The energy coupled over from the first line into the second line is here in most cases not sufficient to enable oscillator circuits to start oscillating. That is why only oscillators having operating frequencies below 18 GHz are produced in most practical applications having ceramic resonators of said kind.

SUMMARY OF THE INVENTION

The object of the invention is to provide a resonator circuit for a filter element for filtering electromagnetic waves which element avoids the disadvantages cited at the beginning. The aim in this regard is to disclose improved coupling of the line(s) to cylindrical, dielectric resonators, in particular for oscillators, preferably for operating frequencies above 18 GHz.

Said object is achieved by means of a filter element for filtering electromagnetic waves which element has the features according to claim 1 and by means of an oscillator having the features according to claim 14. Advantageous embodiments and developments that can be employed either alone or in mutual combination are the subject of the dependent claims.

The invention builds on filter elements of the cited class for filtering electromagnetic waves which elements contain a dielectric, cylindrical resonator and one or more lines terminating in a contacting structure and supplying or, as the case may be drawing off electromagnetic waves to/from the dielectric resonator initially in that said resonator is located variably spaced from the lines, with spacings being conceivable in either the negative or, alternatively, the positive longitudinal direction (z-axis) of the resonator.

In the first-cited case, which is to say when the spacing is in the resonator's negative longitudinal direction, the lines together with their contacting structure preferably form part of a printed-circuit board that supports the resonator, with a recess in which the resonator is located by means of a suitable securing means being inventively provided in said printed-circuit board.

In the case cited as an alternative, which is to say when the spacing is in the resonator's positive longitudinal direction, located in the contacting structure's close proximity is any object or a device, for example a retention area, a cover, or suchlike that holds the resonator in place, with a recess in which the resonator is located by means of a suitable securing means being inventively provided in said retention area or, as the case may be, cover etc.

Owing to the resonator's inventively variably spaced contacting the transmittable signal power is advantageously substantially increased compared to previous structures according to, for example, FIG. 8. Secure excitation and stable operation of an oscillator produced using a filter element of said type can be achieved thereby under practical operating conditions, in particular over a wide temperature range.

A retention area or, as the case may be, cover etc. having a recess holding the resonator in place on the face can, moreover, also be provided in cases in which the resonator is additionally partially "sunk" into a recess on the printed-circuit board, which is to say is located spaced in the negative longitudinal direction from the lines terminating in a contacting structure. A physical design of said type on the one hand facilities assembling of the printed-circuit board and cover etc. and on the other hand, results advantageously in what are termed ultra-compact units of the kind always of interest to the automobile industry in particular.

The recess in the printed-circuit board or, as the case may be, in the previously mentioned device (surface element, cover, etc.) is preferably dimensioned in such a way as to enable the resonator to be fitted or, as the case may be, mounted in a self-centering manner, for example is embodied at least on the ingress side slightly conically or provided with a folded edge or, as the case may be, chamfer.

An adhesive or silicon or suchlike is preferably used as the means for securing the resonator.

Each line preferably terminates in each case in a separately embodied contacting structure. Two or more lines can alternatively also terminate in a commonly embodied contacting structure.

The contacting structure can preferably be embodied at least in sections as sickle-shaped, as a result of which a certain desired filter characteristic can advantageously be achieved. As mentioned at the beginning, it is crucial for operating filter elements of said type or, as the case may be, oscillators constructed therefrom that sufficient signal power is emitted or transmitted by the line or, as the case may be, lines.

The contacting structure can alternatively preferably be embodied as a 360° annulus or, again as an alternative, as a circular-arc segment having a variable aperture angle less than 360°. In particular in the last-cited case the coupling efficiency between the line or, as the case may be, lines and the resonator can advantageously be accommodated and undesired phase jitter minimized by skillfully selecting the aperture angle $\alpha$. Contacting structures having an aperture angle $\alpha$ of approximately 160° have, for instance, proved effective when there are two lines, contacting structures having an aperture angle of approximately 110° have proved effective when there are three lines, and contacting structures having an aperture angle of, for instance, approximately 75° have proved effective when there are four lines, with the above angles being only examples of possible embodiments.

In a development of the invention the contacting structure has larger dimensions than the cylindrical resonator. In order to minimize structural size and/or increase coupling efficiency, as an alternative thereto and provided the resonator is located on the retention area or, as the case may be, cover etc., the contacting structure can also have smaller dimensions than the cylindrical resonator.

The resonator is to practical advantage oriented substantially to be centered relative to the contacting structure or, as the case may be, located in the central area thereof, with coarser deviance tolerances advantageously being allowed in the resonator's positioning in the case of contacting according to the present invention than is the case with conventional circuits where relatively slight deviations can result in the resonator circuit's non-serviceability and hence rejection.

The present invention is particularly suitable for dielectric, cylindrical resonators of a filter element having operating frequencies above 18 GHz. Said invention further relates to an oscillator, in particular for radar systems, LMDS distribution services, satellite receivers, and suchlike, containing a previously described filter element for filtering electromagnetic waves. In this way the invention also displays its advantages within the scope of an overall system.

The invention will now be explained in an exemplary manner with reference to the accompanying drawings and the aid of preferred embodiments.

DESCRIPTION OF THE PREFERRED EMBODIMENTS

Figure 1:
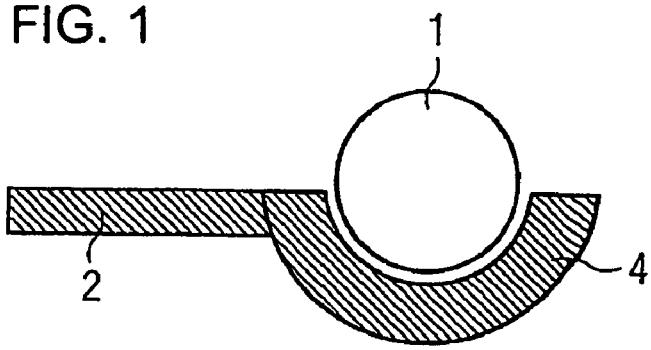
FIG. 1 is a schematic plan view of a first structure of a filter element containing a cylindrical resonator to which is ducted a line at whose end a sickle-shaped contacting structure is embodied.

In the following description of the preferred embodiments of the present invention the same reference numerals refer to the same or comparable components.

FIG. 1 is a top view of a first structure of a filter element containing a cylindrical, dielectric resonator 1 to which is ducted a supply line 2 at whose end a sickle-shaped contacting structure 4 is embodied. The sickle-shaped contacting structure 4 consists of a circular-arc segment having a variable aperture angle $\alpha$ to which is connected a customary line 2. For the example shown in FIG. 1 the aperture angle $\alpha$ is approximately 160°. The width of the line 2 and of the sickle-shaped contacting structure 4 can be accommodated to the relevant conditions and is to be regarded as being variable. One (see FIG. 4), two (see FIG. 3), or more (not shown) contact structures 4, 4*a*, 4*b* can in particular be attached to the dielectric, ceramic resonator 1. This only requires accommodating the aperture angles a of the individual contacting structures accordingly.

Figure 5:
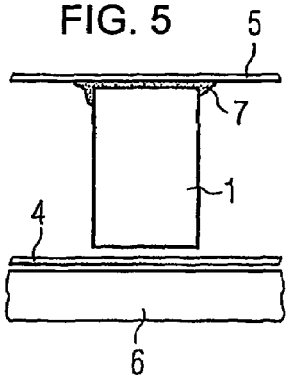
FIG. 5 is a schematic side view of the structure of a filter element according to one of preceding FIGS. 1 to 4 or 8 having a resonator inventively located on a cover and variably space from the contracting structure along the positive z-axis.

The sickle-shaped contacting structure 4, 4*a*, 4*b* can, in particular in the case of the resonator's arrangement shown in FIG. 5 in relation to the contacting structure, also assume dimensions that are smaller than the dimensions of the cylindrical resonator 1. In that case the cylindrical resonator 1 covers the metallic contacting structures 4, 4*a*, 4*b* at least partially.

Figure 2:
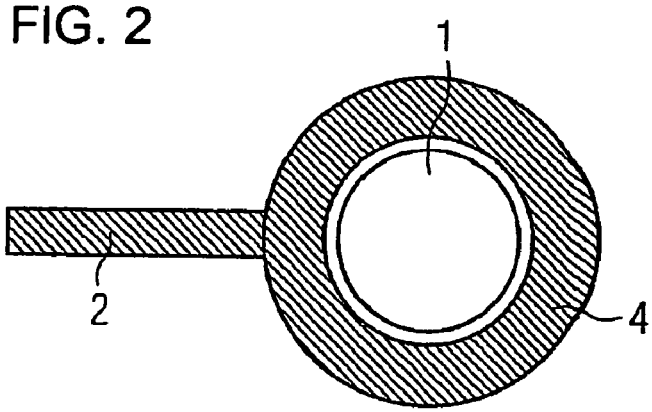
FIG. 2 is a schematic plan view of a second structure of a filter element containing a cylindrical resonator to which is ducted a line at whose end a an annular contacting structure is embodied.

FIG. 2 is a top view of a second structure of a filter element containing a cylindrical resonator 1 to which is ducted a line 2 at whose end an annular contacting structure 4 is embodied.

Figure 3:
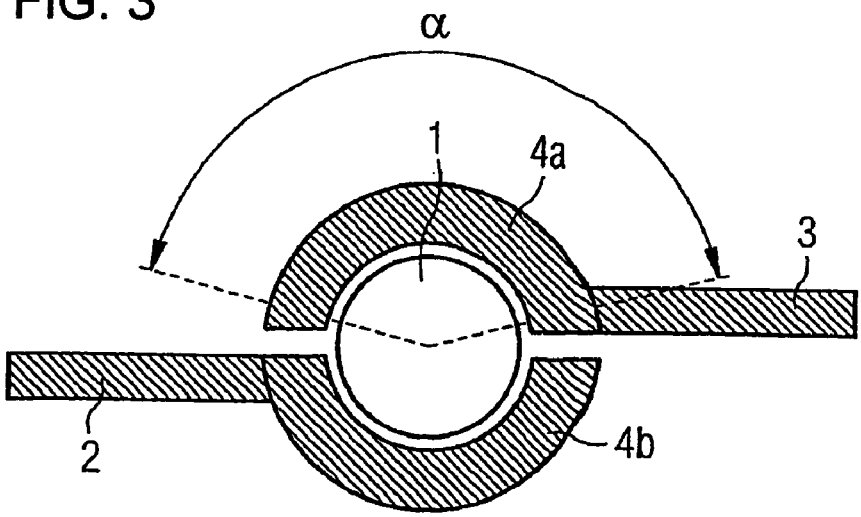
FIG. 3 is a schematic plan view of a third structure of a filter element containing a cylindrical resonator to which are ducted two lines at whose ends a separate sickle-shaped contacting structure is in each case embodied.

FIG. 3 is a top view of a third structure of a filter element containing a cylindrical resonator 1 to which are ducted two lines 2, 3 at whose ends a separate sickle-shaped contacting structure 4*a*, 4*b* is in each case embodied, with the two contacting structures 4*a*, 4*b* being mutually electrically isolated. Contacting structures of said type are suitable particularly in the case of feedback circuits for producing oscillators: The cylindrical resonator 1 is employed in said circuits as a narrowband bandpass filter which, for example, in a defined mode is only permeable for a certain frequency, which is why in this connection the term multi-mode bandpass filter is also used, because, for example, the basic mode or higher-order modes can be used. The resonator 1 is for this purpose, as shown in FIG. 3, contacted with two lines 2, 3. It is crucial for the oscillator's operation that sufficient signal power is emitted or transmitted by the-first line 2 to the second line 3. This is ensured by the sickle-shaped contacting structures 4*a*, 4*b*.

Figure 4:
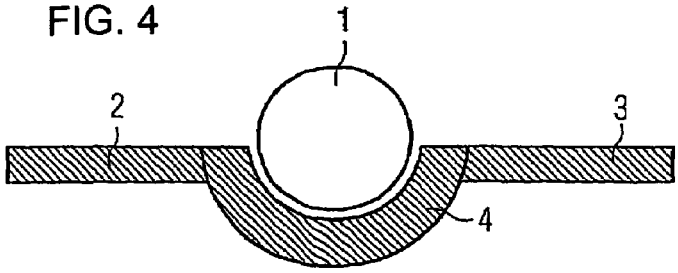
FIG. 4 is a schematic plan view of a fourth structure of a filter element containing a cylindrical resonator to which are ducted two lines terminating in a common sickle-shaped contacting structure.

FIG. 4 is a top view of a fourth structure of a filter element containing a cylindrical resonator 1 to which are ducted two lines 2, 3 terminating in a common sickle-shaped contacting structure 4. Structures of said type in which the supply lines 2, 3 share a sickle-shaped contacting structure 4, 4*a*, 4*b* are suitable particularly as band-stop filters.

FIG. 5 is a side view of the structure of a filter element according to one of preceding FIGS. 1 to 4 or 8 having a resonator 1 inventively located on, for example, a cover 5 and variably spaced from the contacting structure contacting structure 4, 4*a*, 4*b* in the positive direction of the z-axis.

Figure 6:
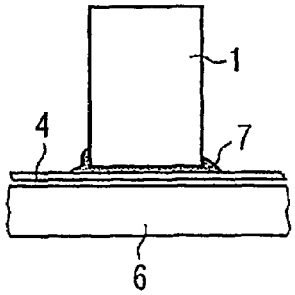
FIG. 6 is a schematic side view of the structure of an oscillator according to one of preceding FIGS. 1 to 4 or 8 having a resonator conventionally located on the contacting structure.

FIG. 6 is a side view of the structure of a filter element according to one of preceding FIGS. 1 to 4 or 8 having a resonator 1 conventionally located on, in particular pasted onto the contacting structure 4, 4*a*, 4*b*.

Figure 7:
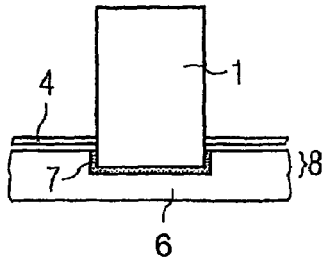
FIG. 7 is a schematic side view of the structure of a filter element according to one of preceding FIGS. 1 to 4 or 8 having a resonator inventively located in a recess in the printed-circuit board and variably spaced from the contacting structure along the negative z-axis.
Figure 8:
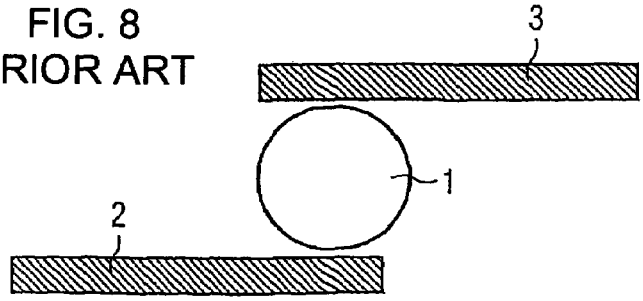
FIG. 8 PRIOR ART
FIG. 8 is a schematic plan view of conventional structure of a filter element containing a cylindrical resonator to which are ducted two supply lines.

Finally, FIG. 7 is a side view of the structure of a filter element according to one of preceding FIGS. 1 to 4 or 8 having a resonator 1 inventively located in a recess 8 in the printed-circuit board 6 and variably spaced from the contacting structure 4, 4*a*, 4*b* in the negative direction of the z-axis.

This means that the height of the cylindrical ceramic resonator 1 (which, incidentally, is sometimes also referred to as a pill) above the surface of a printed-circuit board 6 does not, according to the invention, have to be defined; it is variable. The electrical or, as the case may be, electromagnetic characteristics of the structure can hence be additionally tuned.

The cylindrical resonator 1 can be mechanically secured with the aid of a suitable securing material, in particular an adhesive 7 or suchlike, to any object 5 that can be, for example, a simple retention area located in close proximity to the surface of the printed-circuit board 6 (see FIG. 5). Said object 5 is advantageously a cover as is required to be embodied above the pill (which is to say in the positive z direction) in virtually all practical instances in the embodiment of oscillator circuits or electrical or, as the case may be, electromagnetic filters. Said cover can be embodied from, for example, metal or absorbent materials such as, for example, plastic.

Alternatively—or, where applicable, additionally (not shown) —thereto the cylindrical ceramic resonator 1 can inventively even be located in the negative value range relative to the contacting structure 4, 4*a*, 4*b*, in particular—as shown in FIG. 7—if a recess 8 for the resonator 1 is embodied in the printed-circuit board 6. Particularly advantageous therein are embodiments of recesses 8 allowing a kind of self-centering mounting of the resonator 1 relative to the contacting structure 4, 4*a*, 4*b*. It is again mentioned though only as a supplementary remark that in the embodiment of oscillator circuits a cover (not shown) is required to be embodied above the pill (which is to say in the positive z direction) of filter elements of said type.

The invention includes the arrangement of a resonator 1 variably spaced from a contacting structure 4, 4*a*, 4*b* containing one, two, or more supply or, as the case may be, draw lines 2, 3. With the present invention the transmitted signal power can be advantageously substantially increased compared to conventional coupling structures (see again the bandpass filter shown in FIG. 8). Secure excitation and stable operation of an oscillator produced using a filter element of said type can be achieved thereby under practical operating conditions (for example over a wide temperature range).

The positioning accuracy of the cylindrical resonator 1 is very low. This allows simple and economical production during which the resonator 1 only has to be pasted into the preferably self-centering central area of at least one recess 8 surrounded by the contacting structure 4, 4*a*, 4*b*.

The present invention has been described using a filter element having a cylindrical, dielectric resonator 1. The invention is not, though, restricted to said type of resonator. In particular any type whatsoever of rotationally symmetric resonator—whether embodied as being solid ("disk-type") or hollow-bodied or, as the case may be, partially hollow-bodied ("cylinder-type")—can be the subject of inventive contacting structures.

The present invention is particularly suitable for use in oscillator circuits having operating frequencies above 18 GHz, such as are typically increasingly used in a motor vehicle's environment systems such as Lane Departure Warning (LDW), Blind Spot Detection (BSD), and Rear View Detection etc.

I claim:

1. A filter element for filtering electromagnetic waves, comprising:

a dielectric, cylindrical resonator;

a printed circuit board including one or more lines for supplying or drawing off electromagnetic waves to or from said dielectric resonator; and securing means;

said printed circuit board including a contacting structure, said lines terminating in said contacting structure;

said resonator supported by said printed-circuit board;

said resonator spaced from said contacting structure; and said printed circuit board formed with a recess and said resonator held in said recess by said securing means.

2. The filter element according to claim 1 configured as a bandpass filter or a band-stop filter.

3. The filter element according to claim 1 configured as a reflection filter.

4. The filter element according to claim 1 wherein said recess is dimensioned to enable self-centering fitting or mounting of said resonator.

5. The filter element according to claim 1, wherein said securing means for securing said resonator is selected from the group of adhesive and silicon.

6. The filter element according to claim 1, wherein each said line terminates in a separately embodied contacting structure.

7. The filter element according to claim 1, wherein two or more lines terminate in a commonly embodied contacting structure.

8. The filter element according to claim 1, wherein said contacting structure sickle-shaped at least in sections thereof.

9. The filter element according to claim 1, wherein said contacting structure is formed as an annulus structure.

10. The filter element according to claim 1, wherein said contacting structure is a circular-arc segment having a variable aperture angle less than 360°.

11. The filter element according to claim 1, wherein said lines are two lines and said contacting structure is a circular-arc segment having a variable aperture angle of approximately 160°.

12. The filter element according to claim 1, wherein said lines are three lines and said contacting structure is a circular-arc segment having a variable aperture angle of approximately 110°.

13. The filter element according to claim 1, wherein said lines are four lines and said contacting structure is a circular-arc segment having a variable aperture angle of approximately 75°.

14. The filter element according to claim 1, wherein said contacting structure has larger dimensions than said cylindrical resonator.

15. The filter element according to claim 1, wherein said contacting structure has smaller dimensions than said cylindrical resonator.

16. The filter element according to claim 1, wherein said resonator is substantially centered relative to said contacting structure.

17. The filter element according to claim 1, wherein said resonator has an operating frequency above 18 GHz.

18. In an oscillator configured for radar systems, LMDS distribution services, or satellite receivers, the filter element for filtering electromagnetic waves according to claim 1.

19. A filter element, comprising:

a dielectric, cylindrical resonator;

a printed circuit board including one or more lines for supplying or drawing off electromagnetic waves to or from said dielectric resonator said printed circuit board including a contacting structure, said lines terminating in said contacting structure;

a retention area or cover disposed in close proximity to said contacting structure; and securing means;

said resonator being held in place by said retention area or said cover;

said retention area or said cover spacing said resonator away from said printed circuit board and away from said contacting structure; and said retention area or said cover being formed with recess, wherein said resonator is held by said securing means.

20. The filter element according to claim 19 configured as a bandpass filter or a band-stop filter.

21. The filter element according to claim 19 configured as a reflection filter.

22. The filter element according to claim 19, wherein said recess is dimensioned to enable self-centering fitting or mounting of said resonator.

23. The filter element according to claim 19, wherein said securing means for securing said resonator is selected from the group of adhesive and silicon.

24. The filter element according to claim 19, wherein each said line terminates in a separately embodied contacting structure.

25. The filter element according to claim 19, wherein two or more lines terminate in a commonly embodied contacting structure.

26. The filter element according to claim 19, wherein said contacting structure sickle-shaped at least in sections thereof.

27. The filter element according to claim 19, wherein said contacting structure is formed as an annulus structure.

28. The filter element according to claim 19, wherein said contacting structure is a circular-arc segment having a variable aperture angle less than 360°.

29. The filter element according to claim 19, wherein said lines are two lines and said contacting structure is a circular-arc segment having a variable aperture angle of approximately 160°.

30. The filter element according to claim 19, wherein said lines are three lines and said contacting structure is a circular-arc segment having a variable aperture angle of approximately 110°.

31. The filter element according to claim 19, wherein said lines are four lines and said contacting structure is a circular-arc segment having a variable aperture angle of approximately 75°.

32. The filter element according to claim 19, wherein said contacting structure has larger dimensions than said cylindrical resonator.

33. The filter element according to claim 19, wherein said contacting structure has smaller dimensions than said cylindrical resonator.

34. The filter element according to claim 19, wherein said resonator is substantially centered relative to said contacting structure.

35. The filter element according to claim 19, wherein said resonator has an operating frequency above 18 GHz.

36. In an oscillator configured for radar systems, LMDS distribution services, or satellite receivers, the filter element for filtering electromagnetic waves according to claim 19.

* * * * *